United States Patent [19]

Wilson et al.

[11] Patent Number: 4,582,679

[45] Date of Patent: Apr. 15, 1986

[54] TITANIUM NITRIDE DISPERSION STRENGTHENED ALLOYS

[75] Inventors: Eric G. Wilson; Andrew M. Wilson, both of Preston, England

[73] Assignee: United Kingdom Atomic Energy Authority, London, England

[21] Appl. No.: 715,378

[22] Filed: Mar. 25, 1985

[30] Foreign Application Priority Data

Apr. 6, 1984 [GB] United Kingdom ..... 8408901

[51] Int. Cl.[4] ..... B22F 3/24

[52] U.S. Cl. ..... 419/13; 75/122.1; 75/245; 148/13; 148/37; 148/421; 156/DIG. 75; 156/DIG. 99; 419/23; 419/28; 419/31; 419/34; 419/35; 419/45; 419/54; 419/57; 419/58; 419/63; 419/64; 419/67; 420/421

[58] Field of Search ..... 419/13, 35, 23, 28, 419/31, 34, 45, 54, 57, 58, 37, 63, 64, 67; 148/421; 423/411; 156/DIG. 75, DIG. 99; 75/122.1, 245; 420/421; 501/96

[56] References Cited

U.S. PATENT DOCUMENTS

| | | | |
|---|---|---|---|
| 4,047,981 | 9/1977 | Arnold et al. | 148/16.6 |
| 4,427,461 | 1/1984 | Kindlimann | 148/16.6 |
| 4,464,207 | 8/1984 | Kindlimann | 148/16.6 |

*Primary Examiner*—Stephen J. Lechert, Jr.
*Attorney, Agent, or Firm*—William R. Hinds

[57] ABSTRACT

To increase the creep strength of a titanium-containing alloy which also contains chromium, the alloy powder is heated in the presence of ammonia at a temperature of the order of 700° C. so as to form a layer of chromium nitride(s) on the particles and is then heated further in an inert atmosphere at a temperature between 1000° C. and 1150° C. to dissociate the chromium nitride(s) thereby effecting nitriding of the titanium to titanium nitride which affords dispersion-strengthening of the alloy.

14 Claims, No Drawings

TITANIUM NITRIDE DISPERSION STRENGTHENED ALLOYS

BACKGROUND OF THE INVENTION

This invention relates to titanium nitride dispersion strengthened alloys and their production.

It is known that the creep strength of certain titanium-containing alloys can be increased by the presence of titanium nitride dispersions and that such dispersions can be introduced by treatment of the alloys in powder form. It is also known that when the alloys also contain chromium and nitriding is attempted by heating in ammonia relatively small penetration of the titanium nitride front normally occurs.

FEATURES AND ASPECTS OF THE INVENTION

According to the present invention particles of titanium-containing alloy powder which also contains chromium are heated in the presence of ammonia to form a layer of chromium nitride(s) on the particles and then in an inert atmosphere at a higher temperature to dissociate the chromium nitride(s) and convert substantially all titanium present to titanium nitride.

It is considered that the chromium nitride(s) ($CrN/CrN_2$) forming the layer on the particles after treatment with ammonia can provide a high activity source of nitrogen in an envelope around each particle for reaction with the titanium present and that this is an improvement on a previously proposed route which depended upon transport of nitrogen from nitrided ($CrN/CrN_2$) particles to un-nitrided particles in a blended mixture of the two.

DESCRIPTION OF THE PREFERRED EMBODIMENT

The invention is considered particularly applicable to titanium containing stainless steel and nickel based alloy powders which are subsequently to be formed into fuel element containers or other nuclear reactor components and have a particle size between 30 and 120 microns. An example of a stainless steel is a 20Cr/25Ni alloy containing up to 2 $^{wt}$/o Ti. An example of a nickel based alloy is that known as Nimonic PE16. Such components may be formed by conventional powder metallurgy techniques, for example, powder extrusion. In particular they may be formed into tubing. A suitable temperature for the treatment with ammonia is about 700° C. and for the subsequent homogenisation between 1000° C. and 1150° C. By homogenisation is meant the high temperature transport of nitrogen from the chromium nitride layer. It includes dissociation, diffusion and chemical reaction processes and can be achieved by heating the powder rapidly to the dissociation temperature, for example, by pouring the powder into a hot furnace or by increasing the temperature of the nitriding furnace. The atmosphere during the homogenising stage may be a hydrogen/nitrogen mixture to maintain a suitable nitrogen activity. Preferably the duration of treatment is extended beyond completion of the formation of the titanium nitride by changing the atmosphere to hydrogen to remove excess nitrogen which could form embrittling phases in service if allowed to remain in solid solution.

We claim:

1. Method for the production of titanium nitride dispersion strengthened alloys, such method including the steps of subjecting particles of titanium-containing alloy powder which also contains chromium to heating in the presence of ammonia to form a layer of chromium nitride(s) on the particles, and then to heating at a higher temperature and in an inert atmosphere to dissociate the chromium nitride(s) and to convert substantially all the titanium present to titanium nitride.

2. Method according to claim 1, wherein the titanium-containing alloy powder is a titanium-containing stainless steel powder.

3. A method according to claim 1, wherein the titanium-containing alloy powder is a titanium-containing nickel based alloy powder.

4. Method according to claim 1, wherein the powders are subsequently formed into nuclear reactor components, including fuel element containers, and having a particle size lying between 30 and 120 microns.

5. Method according to claim 4, wherein the components are tubes and are formed by powder extrusion.

6. Method according to claim 1, wherein the heating in the presence of ammonia is carried out at a temperature in the region of 700° C.

7. Method according to claim 1, wherein the subsequent heating in an inert atmosphere is homogenisation carried out at a temperature between 1000° C. and 1150° C.

8. Method according to claim 1, wherein the heating in the presence of ammonia is carried out at a temperature in the region of 700° C., and the subsequent heating in an inert atmosphere is homogenisation carried out at a temperature between 1000° C. and 1150° C.

9. Method according to claim 7, wherein the said homogenisation is achieved by heating the powder rapidly to the said temperature in an atmosphere consisting of a mixture of hydrogen and nitrogen, and extending the heat treatment beyond completion of the formation of titanium nitride together with changing the atmosphere to hydrogen whereby to remove excess nitrogen.

10. Method according to claim 8, wherein the said homogenisation is achieved by heating the powder rapidly to the said temperature in an atmosphere consisting of a mixture of hydrogen and nitrogen, and extending the heat treatment beyond completion of the formation of titanium nitride together with changing the atmosphere to hydrogen whereby to remove excess nitrogen.

11. Alloys and articles made therefrom, when produced by a method according to claim 1.

12. A method for the production of titanium nitride dispersion strengthened alloy powders, comprising the steps of subjecting particles of titanium-containing alloy powder having a particle size between about 30 and about 120 microns and which also contains chromium to heating at a temperature of about 700° C. in the presence of ammonia to form a layer of chromium nitride(s) on each individual particle, and then rapidly heating to a higher temperature between about 1000° C. and 1150° C. in an inert atmosphere to dissociate the chromium nitride(s) and to convert substantially all the titanium present to titanium nitride.

13. In a method of making nuclear reactor components comprising forming the components by powder metallurgy techniques from titanium-containing alloy powder, the improvement comprising providing titanium nitride dispersion strengthened alloy as the alloy powder by subjecting particles of titanium-containing alloy powder which also contains chromium to heating at a temperature of about 700° C. in the presence of ammonia to form a layer of chromium nitride(s) on each individual particle, and then rapidly heating to a higher temperature between about 1000° C. and 1150° C. in an inert temperature to dissociate the chromium nitride(s) and to convert substantially all the titanium present to titanium nitride, the initial alloy powder having a particle size such that the resulting titanium nitride dispersion strengthened alloy powder is of a particle size between about 30 and about 120 microns.

14. A method as claimed in claim 13 wherein the components are tubes and are formed by powder extrusion of the titanium nitride dispersion strengthened alloy powder.

* * * * *